US010751964B2

(12) United States Patent
Galkin et al.

(10) Patent No.: US 10,751,964 B2
(45) Date of Patent: Aug. 25, 2020

(54) HEAT PRESS WITH SELF-ADJUSTING CLAMP FORCE

(71) Applicant: GroupeSTAHL, Sterling Heights, MI (US)

(72) Inventors: Anton Galkin, Carmichaels, PA (US); Benjamin Robinson, Carmichaels, PA (US)

(73) Assignee: STAHLS' INC., Sterling Heights, MI (US)

( * ) Notice: Subject to any disclaimer, the term of this patent is extended or adjusted under 35 U.S.C. 154(b) by 443 days.

(21) Appl. No.: 15/467,214

(22) Filed: Mar. 23, 2017

(65) Prior Publication Data

US 2018/0093439 A1 Apr. 5, 2018

Related U.S. Application Data

(60) Provisional application No. 62/403,945, filed on Oct. 4, 2016.

(51) Int. Cl.
*B30B 15/12* (2006.01)
*B30B 1/12* (2006.01)
(Continued)

(52) U.S. Cl.
CPC ..... *B30B 15/12* (2013.01); *B30B 1/12* (2013.01); *B30B 15/34* (2013.01); *B41F 16/0046* (2013.01); *B41F 16/02* (2013.01)

(58) Field of Classification Search
CPC ..... B30B 15/12; B30B 1/12; B30B 15/34; B30B 1/04; B30B 1/02; B29C 66/81; B29C 66/8226; B29C 66/8221; B29C 66/814; B29C 66/812; B29C 66/816; B29C 66/818; B29C 66/82; B29C 66/83;
(Continued)

(56) References Cited

U.S. PATENT DOCUMENTS 154,286 A * 8/1874 Selden ..... B30B 1/26 100/292
2,644,151 A * 6/1953 Krueger ..... B30B 15/34 100/319

(Continued)

FOREIGN PATENT DOCUMENTS

CA 2835936 A1 6/2015

*Primary Examiner* — Teresa M Ekiert
*Assistant Examiner* — Sarkis A Aktavoukian
(74) *Attorney, Agent, or Firm* — Harness, Dickey & Pierce, PLC

(57) ABSTRACT

A heat press includes a clutch and a linkage that moves the upper platen relative to the lower platen. A first link is pivotably coupled to the base and pivotably coupled to an intermediate link. The intermediate link can rotate in a first rotational direction from a first rotational position to a second rotational position. A first clutch member can be coupled to the intermediate link. A second clutch member can be mounted to the upper platen for common movement with the upper platen. When the intermediate link is in the first rotational position, the clutch can be disengaged to permit relative movement in the clamping direction between the first and second clutch members. When the intermediate link is in the second rotational position, the clutch can be engaged to inhibit relative movement between the first and second clutch members.

14 Claims, 15 Drawing Sheets

(51) Int. Cl.
*B30B 15/34* (2006.01)
*B41F 16/00* (2006.01)
*B41F 16/02* (2006.01)

(58) Field of Classification Search
CPC ..... B29C 66/8286; B41F 1/38; B41F 16/02; B41P 2213/254; B41P 2213/25
USPC ..... 100/38, 234, 92, 233, 280, 283; 156/583.8, 583.6, 583.1, 583.91
See application file for complete search history.

(56) References Cited

U.S. PATENT DOCUMENTS

| | | | | |
|---|---|---|---|---|
| 3,789,680 | A | 2/1974 | Blatt | |
| 4,065,990 | A * | 1/1978 | Edhlund | B26F 1/02 83/133 |
| 5,252,171 | A | 10/1993 | Anderson et al. | |
| 5,474,633 | A | 12/1995 | Myers | |
| 6,058,834 | A * | 5/2000 | Beckwith | B30B 1/12 100/233 |
| 6,151,814 | A | 11/2000 | Raio et al. | |
| 7,185,584 | B1 | 3/2007 | Woods et al. | |
| 7,975,811 | B2 | 7/2011 | Berliant | |
| 8,042,588 | B2 | 10/2011 | Robinson et al. | |
| 8,613,433 | B2 | 12/2013 | Poole et al. | |
| 9,038,690 | B1 | 5/2015 | Hsiao et al. | |
| 2016/0250816 | A1 | 9/2016 | Robinson et al. | |

* cited by examiner

HEAT PRESS WITH SELF-ADJUSTING CLAMP FORCE

This application claims the benefit of U.S. Provisional Application No. 62/403,945, filed on Oct. 4, 2016. The entire disclosure of the above application is incorporated herein by reference.

FIELD

The present disclosure relates to a heat press with self-adjusting clamp force.

BACKGROUND

This section provides background information related to the present disclosure which is not necessarily prior art.

Heat presses for heat and pressure printing and transfer applications typically include a lower platen and an upper platen that is generally above the lower platen and configured to press down on the lower platen. Typically, a work piece (e.g., fabric or garment) and a heat-activated article (e.g., letters, logos, images, graphics) are positioned on the lower platen while the upper platen is separated from the lower platen. Once the work piece and article are properly positioned, the upper platen is moved vertically down over the lower platen to sandwich the work piece and article between the upper and lower platens. One or both of the platens typically contains a heating element and the platens are typically configured to apply heat and pressure to the work piece and article for a predetermined amount of time (i.e., cure time). After the cure time is completed, the upper platen is lifted up so that the operator can remove the finished product and repeat the steps for the next work piece and article.

On a typical manual heat press, the lower platen is attached to a base structure and the upper platen is attached to a handle and clamping linkage mechanism which is pivotably attached to the base structure to move the electrically heated upper platen between a clamped position, precisely aligned above the lower platen, and an open position spaced apart from the lower platen to allow the operator access to the lower platen. The upper platen is typically moved vertically relative to the lower platen by an operator manipulating the handle. In typical heat presses, the clamping linkage has an over-center locking condition to compress the platens together in the clamped position, bending the steel structure of the press to provide repeatable and predictable clamping force. The handle and linkages can serve to mechanically amplify the operator's strength and can clamp a garment between the upper and lower platen with a clamping force that can be pre-set based on a predetermined thickness of a workpiece and article. Since a specific clamping pressure can be required for each heat transfer application, a mechanical adjustment is typically required to alter the total deflection of the press structure when clamped, thus altering the applied force between the two platens. Automated (i.e., non-manual) heat presses can have similar clamping mechanisms. Thus, typical heat presses require periodic adjustment to maintain a constant clamping force between garments of differing thickness, which can increase operating time and costs.

SUMMARY

This section provides a general summary of the disclosure, and is not a comprehensive disclosure of its full scope or all of its features.

In one form, the present teachings provide for a heat press which can include a base, a lower platen, an upper platen, a linkage, and a clutch. The lower platen can be mounted to the base. The linkage can move the upper platen relative to the lower platen along a clamping direction between a first platen position and a second platen position. In the second platen position, the upper platen can be spaced apart from the lower platen a lesser distance than when in the first platen position. The linkage can include a first link member pivotably coupled to the base, and a first intermediate link member pivotably coupled to the first link member. The first intermediate link member can rotate in a first rotational direction from a first rotational position to a second rotational position. The clutch can include a first clutch member and a second clutch member. The first clutch member can be coupled to the first intermediate link member. The second clutch member can be mounted to the upper platen for common movement in the clamping direction with the upper platen. When the first intermediate link member is in the first rotational position, the clutch can be disengaged to permit relative movement in the clamping direction between the first and second clutch members. When the first intermediate link member is in the second rotational position, the clutch can be engaged to inhibit relative movement in the clamping direction between the first and second clutch members.

According to a further embodiment of the invention, the first clutch member can be pivotably coupled to the first intermediate link member. The first intermediate link member can include a first cam surface. The first clutch member can include a corresponding first follower surface that can cooperate with the first cam surface to move the first clutch member toward the second clutch member when the first intermediate link is rotated in the first rotational direction from the first rotational position to the second rotational position.

According to a further embodiment of the invention, the first intermediate link member and the first clutch member can be pivotably coupled by a first pivot member and the first cam surface can be disposed about the first pivot member.

According to a further embodiment of the invention, the linkage can include a second intermediate link member and the clutch can include a third clutch member. The second clutch member can be disposed between the first and third clutch members. The second intermediate link member can be pivotably coupled to the first link member. The third clutch member can be pivotably coupled to the second intermediate link member. The second intermediate link member can include a second cam surface and the third clutch member can include a corresponding second follower surface that can cooperate with the second cam surface to move the third clutch member toward the second clutch member when the first intermediate link member is moved from the first rotational position to the second rotational position. When the first intermediate link member is in the first rotational position, the second clutch member can be permitted to move in the clamping direction relative to the third clutch member. When the first intermediate link member is in the second rotational position, the third clutch member can be engaged with the second clutch member to inhibit relative movement in the clamping direction between the second and third clutch members.

According to a further embodiment of the invention, the first clutch member can include a first friction surface and the second clutch member can include a second friction surface. When the first intermediate link member is in the second rotational position, friction between the first and second friction surfaces can inhibit movement of the second clutch member in the clamping direction relative to the first clutch member.

According to a further embodiment of the invention, the first clutch member can include a first surface and the second clutch member can include a second surface. When the first intermediate link member is in the second rotational position, the first surface can overlap the second surface and contact the second surface to prevent relative movement between the first and second clutch members in the clamping direction. When the first intermediate link member is in the first rotational position, the first surface can be configured to not overlap the second surface.

According to a further embodiment of the invention, the heat press can further include a support guide. The support guide can be fixedly coupled to the base. One of the support guide or the second clutch member can include a rail. The other of the support guide or the second clutch member can include a channel. The channel can extend in the clamping direction and the rail can be slidingly disposed within the channel.

According to a further embodiment of the invention, the second clutch member can include a first guide groove that can extend along the clamping direction. The first clutch member can be at least partially received within the first guide groove.

According to a further embodiment of the invention, the second clutch member can be disposed above the upper platen. A longitudinal axis of the second clutch member can be aligned with a center of the upper platen. The longitudinal axis can be parallel to the clamping direction.

According to a further embodiment of the invention, the base can include a resilient member. The resilient member can be configured to resiliently flex a predetermined amount when the first intermediate link member rotates further in the first rotational direction from the second rotational position to a third rotational position.

In another form, the present teachings provide for a heat press which can include a base, a lower platen, an upper platen, a linkage, and a support body. The lower platen can be mounted to the base. The linkage can move the upper platen relative to the lower platen along a clamping direction between a first platen position and a second platen position. In the second platen position, the upper platen can be spaced apart from the lower platen a lesser distance than when in the first platen position. The linkage can include a first link member, a first intermediate link member, and a first brake member. The first link member can be pivotably coupled to the base. The first intermediate link member can be pivotably coupled to the first link member. The first brake member can be pivotably coupled to the first intermediate link member. The first intermediate link member can include a first cam surface and the first brake member can include a corresponding first follower surface. The support body can be mounted to the upper platen for common movement with the upper platen. The support body and the first brake member can be coupled together to form a prismatic joint. The first cam surface and the first follower surface can cooperate to move the first brake member relative to the support body between a disengaged position and an engaged position when the first intermediate link member rotates relative to the first brake member. When the first brake member is in the disengaged position, the support body can be permitted to move relative to the first brake member along the clamping direction. When the first brake member is in the engaged position, the first brake member can engage the support body to inhibit movement of the support body in the clamping direction relative to the first brake member.

According to a further embodiment of the invention, the linkage can include a second intermediate link member and a second brake member. The second intermediate link member can be pivotably coupled to the first link member. The second brake member can be pivotably coupled to the second intermediate link member. The second intermediate link member can include a second cam surface and the second brake member can include a corresponding second follower surface. The support body can be disposed between the first and second brake members. The second cam surface and the second follower surface can cooperate to move the second brake member relative to the support body between a disengaged position and an engaged position when the second intermediate link member rotates relative to the second brake member. When the second brake member is in the disengaged position, the support body can be permitted to move relative to the second brake member along the clamping direction. When the second brake member is in the engaged position, the second brake member can engage the support body to inhibit movement of the support body in the clamping direction relative to the second brake member.

According to a further embodiment of the invention, the first brake member can include a first surface and the support body can include a second surface. When the first brake member is in the engaged position, friction between the first and second surfaces can inhibit movement of the support body in the clamping direction relative to the first brake member.

According to a further embodiment of the invention, the first brake member can include a first surface and the support body can include a second surface. When the first brake member is in the engaged position, the first surface can overlap the second surface and contact the second surface to prevent relative movement between the support body and the first brake member in the clamping direction. When the first brake member is in the disengaged position, the first surface can be configured to not overlap the second surface.

According to a further embodiment of the invention, the first brake member can include a first set of teeth and the support body can include a second set of teeth. When the first brake member is in the engaged position, the first and second sets of teeth can be meshingly engaged to prevent relative movement between the support body and the first brake member in the clamping direction. When the first brake member is in the disengaged position, the first and second sets of teeth can be spaced apart.

According to a further embodiment of the invention, the first link member can include a handle configured to be articulated by a user of the heat press.

According to a further embodiment of the invention, the heat press can further include a support guide. The support guide can be fixedly coupled to the base. One of the support guide or the support body can include a rail. The other of the support guide or the support body can include a channel. The channel can extend in the clamping direction and the rail can be slidingly disposed within the channel.

According to a further embodiment of the invention, the support body can include a first guide groove that can extend along the clamping direction. The first brake member can be at least partially received within the first guide groove.

According to a further embodiment of the invention, the support body can be disposed above the upper platen. A longitudinal axis of the support body can be aligned with a center of the upper platen. The longitudinal axis can be parallel to the clamping direction.

According to a further embodiment of the invention, the first intermediate link member and the first brake member can be pivotably coupled by a first pivot member and the first cam surface can be disposed about the first pivot member.

In another form, the present teachings provide for a heat press which can include a base, a lower platen, an upper platen, a linkage, and a support body. The lower platen can be fixedly mounted to the base. The linkage can move the upper platen relative to the lower platen between a first platen position and a second platen position. In the second platen position, the upper platen can be spaced apart from the lower platen a lesser distance than when in the first platen position. The linkage can include a handle, a pair of intermediate links, and a pair of brake members. The handle can be pivotably coupled to the base. The intermediate links can be pivotably coupled to the handle. The brake members can be pivotably coupled to the intermediate links. Each intermediate link can include a cam surface and each brake member can include a corresponding follower surface. The support body can be mounted to the upper platen. The support body and brake members can form a prismatic joint. The cam surfaces and the follower surfaces can cooperate to move the brakes relative to the support body between a first brake position and a second brake position. In the first brake position, the support body is permitted to move along a clamping direction relative to the brake members. In the second brake position, the brake members engage the support body to inhibit movement of the support body relative to the brake members.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

The present teachings are directed toward a heat press with self-adjusting clamp force that combines a clamping linkage with a self-locking prismatic sliding joint to achieve a 2-stage self-locking mechanism.

Figure 1:
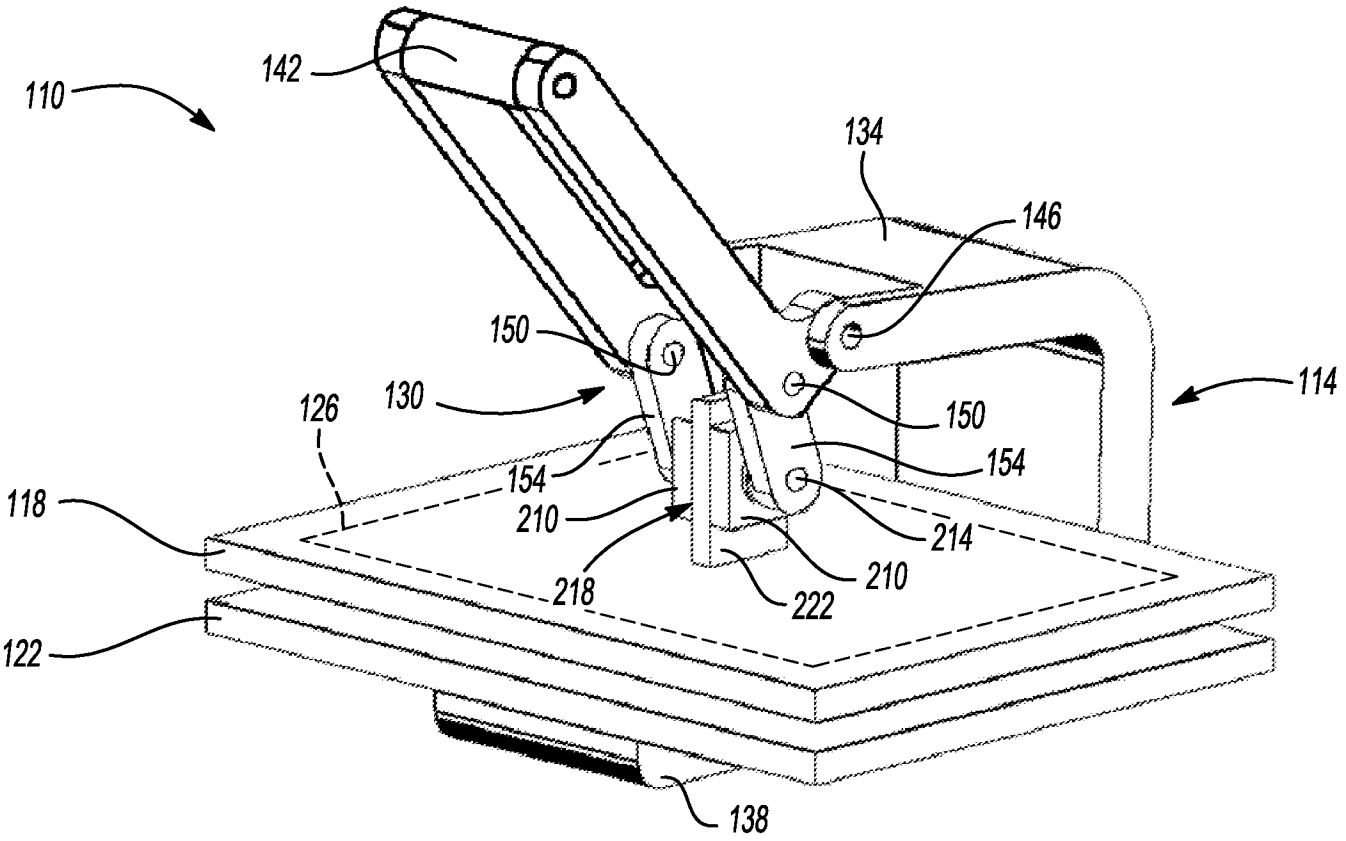
FIG. 1 is a perspective view of a heat press in accordance with the present teachings.

With reference to FIG. 1, an example of a heat press 110 is illustrated. The heat press 110 can include a base 114, an upper platen 118, a lower platen 122, a heating element 126, and a clamping lever-crank mechanism or linkage 130. In the example provided, the heat press 110 is illustrated as a manual heat press, though other constructions can be used. For example, the present teachings are also applicable to heat presses wherein the linkage 130 is moved by an electric motor or a pneumatic or hydraulic actuator, instead of a user.

The base 114 can be a rigid structure that can include an upper structure 134 and a lower structure 138 fixedly coupled to the upper structure 134. The lower structure 138 can extend below the lower platen 122 and can support the lower platen 122 above a floor or workbench (not specifically shown). The upper structure 134 can extend upward from a rear of the lower structure 138, and then forward to a location above the upper and lower platens 118, 122.

In an alternative construction, not specifically shown, the lower structure 138 can be rotatably coupled to the upper structure 134, such that the upper structure 134 can pivot about an axis that can be parallel to the clamping direction (e.g., perpendicular to the upper and lower platens 118, 122). In other words, the upper structure 134 can rotate relative to the lower structure 138 until the upper platen 118 is no longer directly above the lower platen 122, so that the operator can access the lower platen 122 more easily.

Returning to the example provided, the linkage 130 can include a first link member (e.g., handle 142), which is movable (e.g., by an operator, electric motor, or an actuator) and pivots about a joint 146 on the upper structure 134. The joint 146 can be above the upper platen 118, and can be located approximately aligned with a center of the upper platen 118. The handle 142 can connect via rotating joints 150 to a pair of intermediate links 154, which can be referred to as "pressure links." In the example provided, there are two pressure links 154 to facilitate a double shear condition and reduce unwanted bending moments on the linkage 130.

Generally, rotation of the handle 142 can cause the upper platen 118 to move relative to the lower platen 122 between an open position, wherein the upper platen 118 is spaced apart from the lower platen 122, and a closed position, wherein the upper platen 118 is closer to the lower platen 122 than when in the open position. While the upper and lower platens 118, 122 are illustrated as being planar platens (i.e., the upper platen 118 and lower platen 122 have opposing surfaces that are planar to press the workpiece between the planar opposing surfaces), other configurations can be used. For example, the opposing surface of the upper platen 118 and/or the lower platen 122 can be a curved surface (e.g., concave or convex).

The heating element 126 can be any suitable type of heating element, such as an electrical resistance element and can be disposed within the upper platen 118 to heat the upper platen 118. The heating element 126 can be configured to heat the upper platen 118 to a predetermined temperature. In an alternative construction, not specifically shown, the heating element 126 can be disposed within the lower platen 122. Operation of the heat press 110 will be described in greater detail below.

Figure 2:
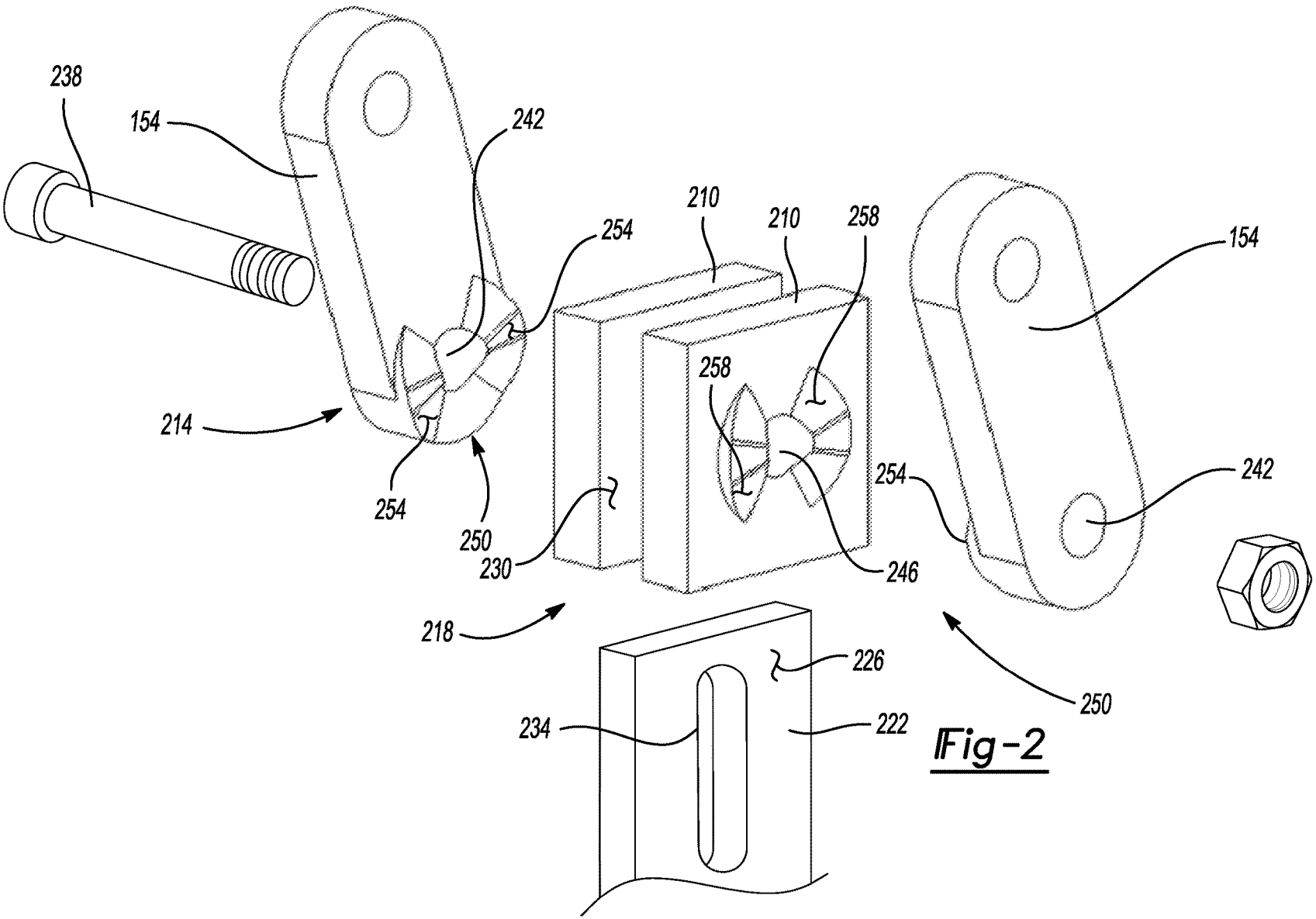
FIG. 2 is a perspective exploded view of a portion of a linkage mechanism of the heat press of FIG. 1.

With continued reference to FIG. 1 and additional reference to FIG. 2, each intermediate link 154 can connect to a first clutch member or brake member 210 via a rotating joint 214. The brake members 210 can be connected by a prismatic joint 218 parallel to the platen clamping direction and centrally located to the clamping force point of application (e.g., centered on the upper platen 118). The prismatic joint 218 can include a second clutch member or platen support body 222 that can be fixedly attached to the upper platen 118 and extends upward from a top surface of the upper platen 118. The platen support body 222 can have a pair of opposite, parallel contact surfaces 226 that each face one of the intermediate links 154. Each brake member 210 can have a mating contact surface 230 that can be parallel to and oppose one of the contact surfaces 226.

In the example provided, the platen support body 222 includes an elongated slot 234 that extends through the platen support body 222 and through the contact surfaces 226. The elongated slot 234 can extend longitudinally in the clamping direction (e.g., up and down relative to the base 114) and can be aligned with the rotating joint 214. In the example provided, the rotating joint 214 includes a rod 238 that extends through apertures 242 in the intermediate links 154, apertures 246 in the brake members 210, and the elongated slot 234. In the example provided, the rod 238 is a bolt and is secured in place by a nut. Washers and/or bearings (not specifically shown) may also be used to facilitate relative rotation between the rod 238 (e.g., bolt and nut), and the intermediate links 154 or brake members 210.

The interface between the intermediate links 154 and the brake members 210 can be shaped to create a helical joint 250 or screw pair connection. In the example provided, the helical joint 250 includes a cam surface 254 on each intermediate link 154 and a follower surface 258 on each brake member 210, such that rotation of the intermediate links 154 relative to the brake members 210 can move the brake members 210 laterally in the direction of their relative rotational axis. In other words, rotation of the intermediate links 154 relative to the brake members 210 can move the brake members 210 toward or away from each other. This lateral movement of the brake members 210 can cause interference in the prismatic joint 218, engaging the brake members 210 to the platen support body 222 and locking the prismatic joint 218 using frictional contact between the contact surfaces 226 and the mating contact surfaces 230. While not specifically shown, a spring can bias the brake members 210 laterally outward such that the cam surfaces 254 remain engaged with the follower surfaces 258. Additionally, the clamping force can be adjusted by tightening or loosening the nut on the bolt of rod 238, such that the cam and follower surfaces 254, 258 engage at different angular locations of the handle 142 relative to the upper structure 134.

Figure 3:
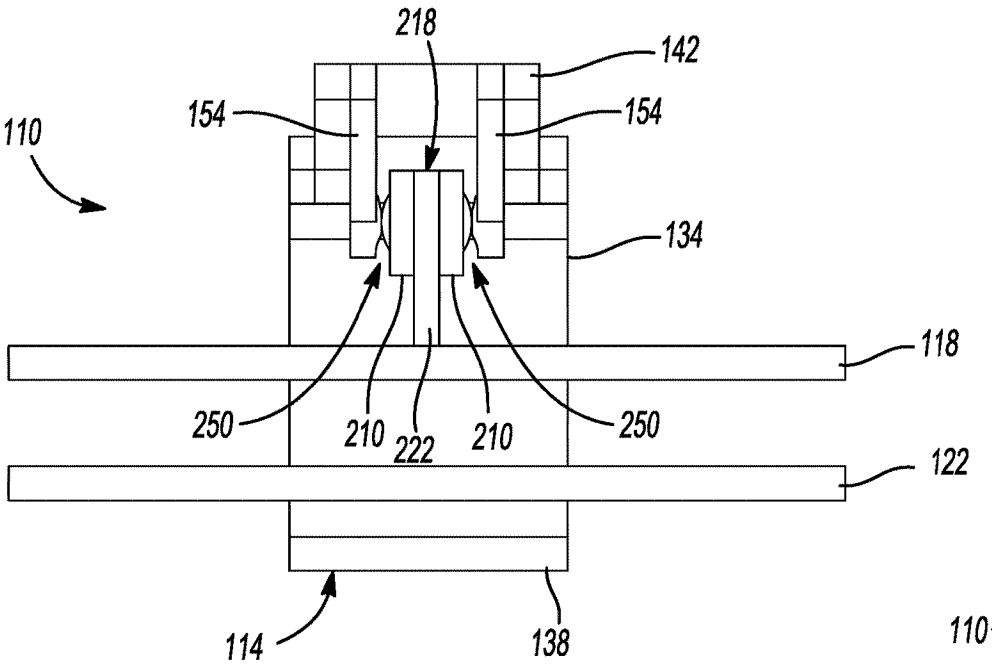
FIG. 3 is a front view of the heat press of FIG. 1, illustrating the linkage mechanism in a first position.
Figure 4:
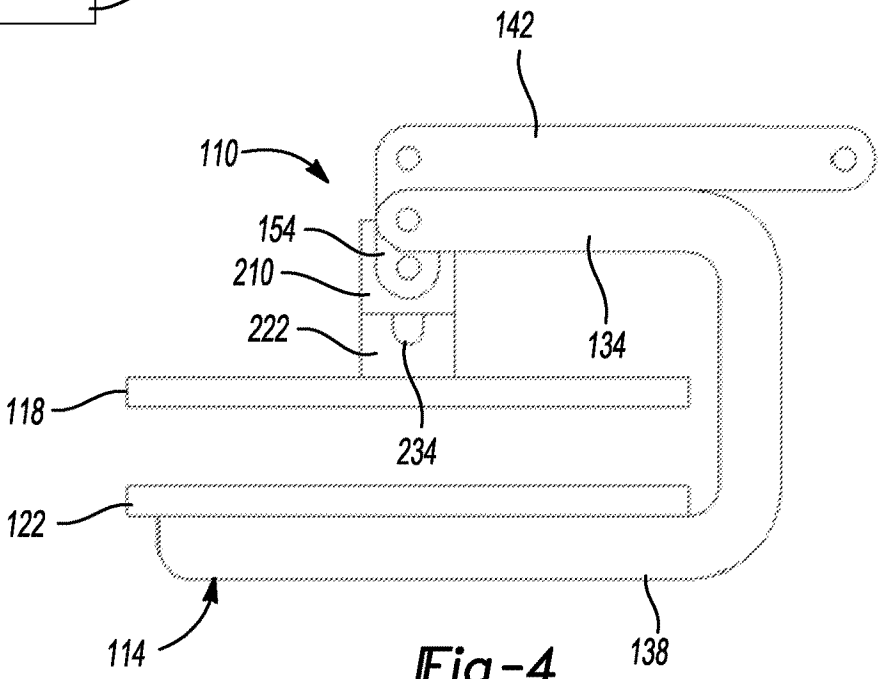
FIG. 4 is a side view of the heat press of FIG. 1, illustrating the linkage mechanism in the first position.

With additional reference to FIGS. 3 and 4, the linkage 130 can begin in a locked state when the press is fully "open" and the handle 142 is in a raised position. In this position, the helical joint 250 can be positioned such that the brake members 210 are engaged with the platen support body 222 to inhibit vertical movement of the upper platen 118. This position can be advantageous for transportation of the mechanism as it prevents unwanted relative motion of its components. This position can also allow the operator to position a workpiece (e.g., fabric or garment) and a heat-activated article (e.g., letters, logos, images, graphics) on the lower platen 122.

Figure 6:
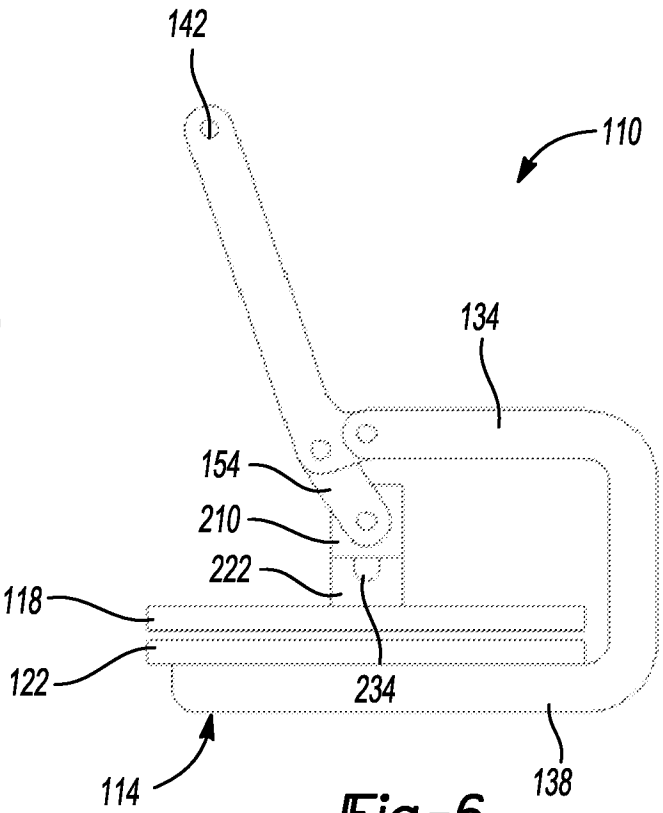
FIG. 6 is a side view of the heat press of FIG. 1, illustrating the linkage mechanism in the second position.
Figure 5:
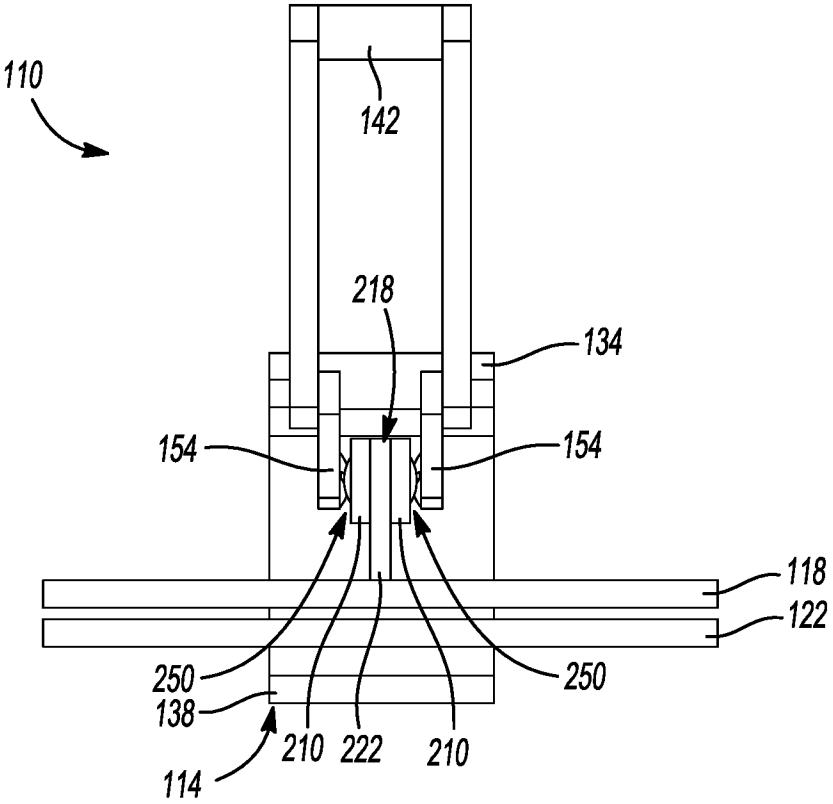
FIG. 5 is a front view of the heat press of FIG. 1, illustrating the linkage mechanism in a second position.

With additional reference to FIGS. 5 and 6, when the handle 142 is moved by the operator, the upper platen 118 begins to lower and the brake members 210 disengage the platen support body 222. The prismatic joint 218 can be maintained in its lowest position by gravity, or with the aid of a spring (not specifically shown).

Figure 8:
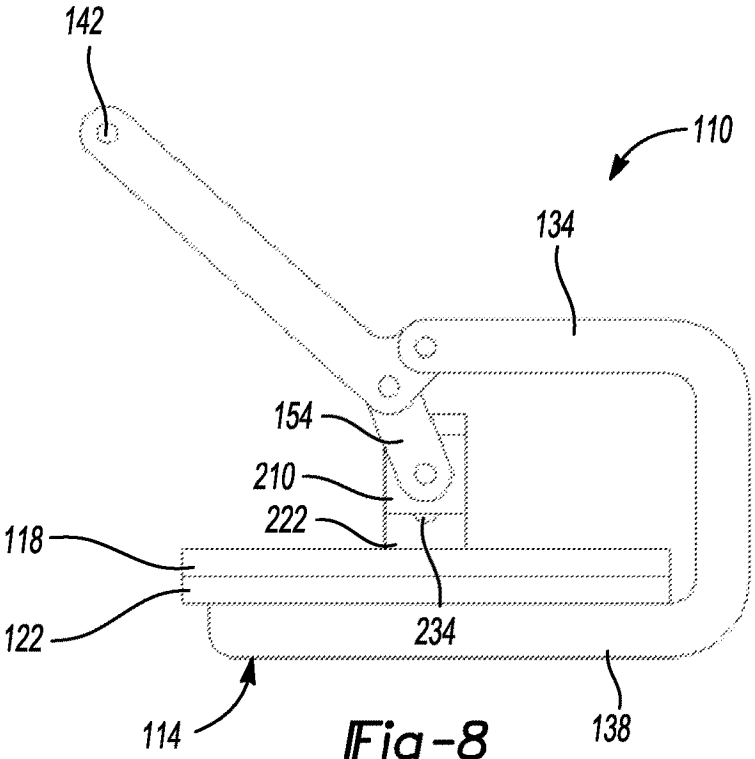
FIG. 8 is a side view of the heat press of FIG. 1, illustrating the linkage mechanism in the third position.
Figure 7:
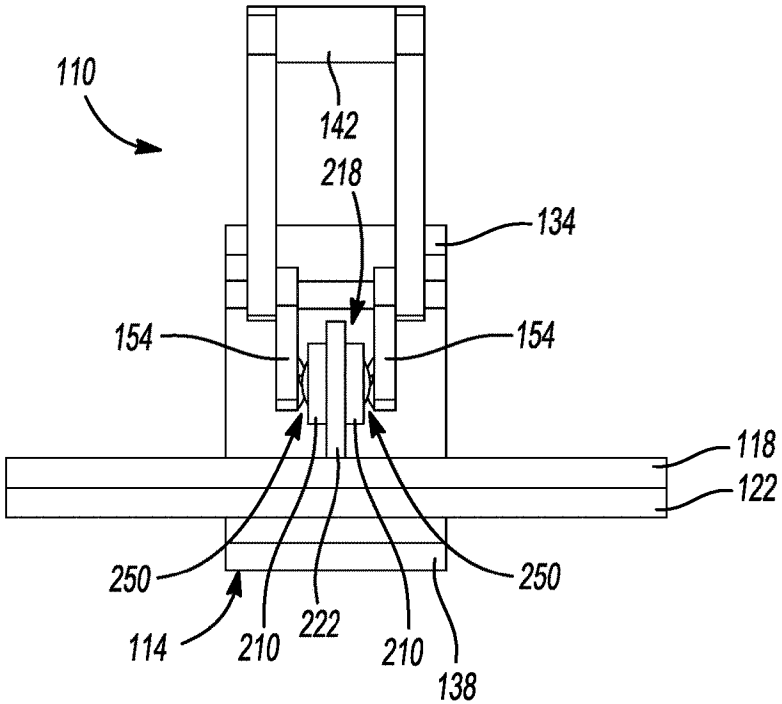
FIG. 7 is a front view of the heat press of FIG. 1, illustrating the linkage mechanism in a third position.

With additional reference to FIGS. 7 and 8, when the upper platen 118 makes contact with the work piece (not specifically shown), sandwiching it between the upper platen 118 and the lower platen 122, the brake member 210 begins to move downward along the prismatic joint 218 until the relative angle between the intermediate link 154 and the brake member 210 (i.e., the position of the cam surfaces 254 and follower surfaces 258) cause the brake members 210 to engage the platen support body 222 and restrict further motion of the prismatic joint 218. Thus, the brake members 210, platen support body 222, and intermediate links 154 can form a clutch to selectively lock the prismatic joint 218.

Figure 9:
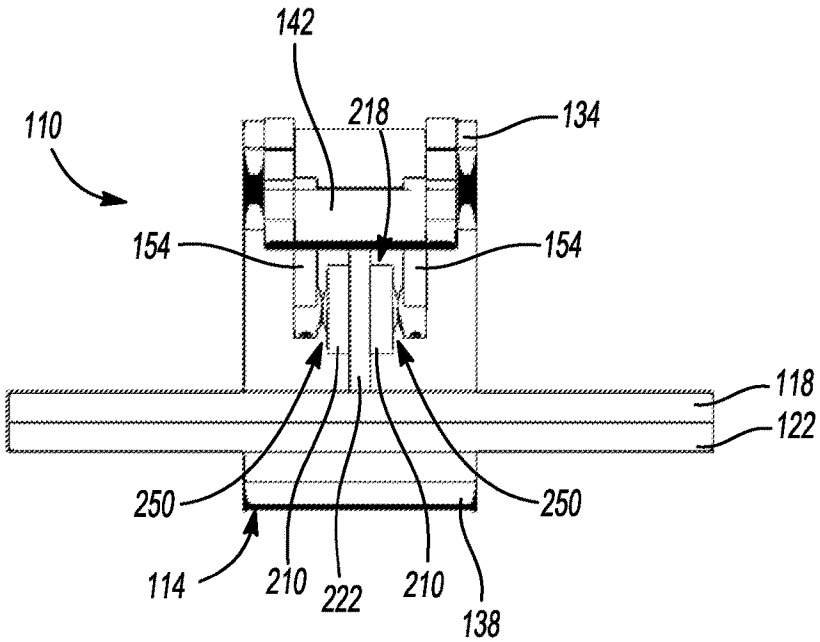
FIG. 9 is a front view of the heat press of FIG. 1, illustrating the linkage mechanism in a fourth position.
Figure 10:
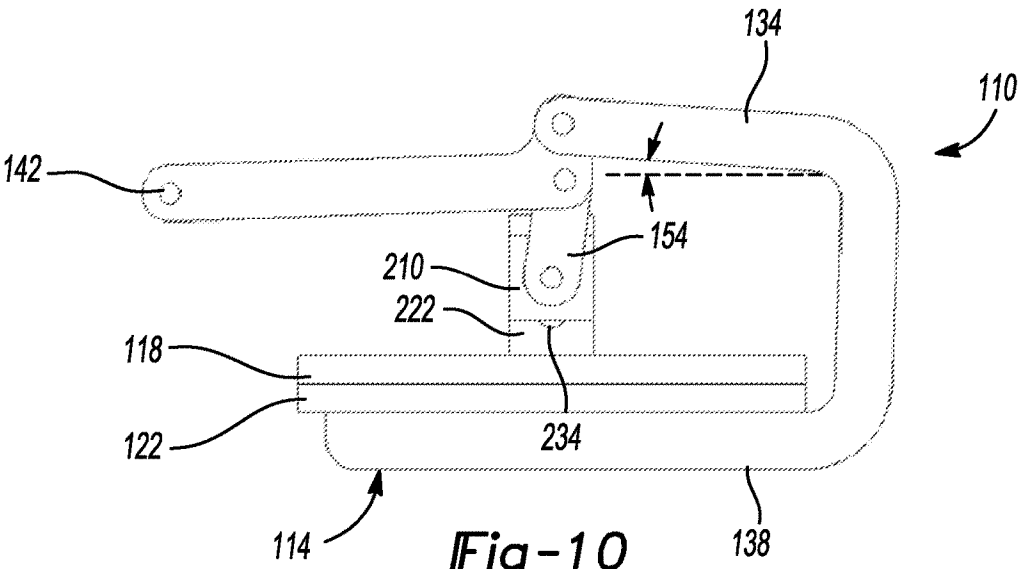
FIG. 10 is a side view of the heat press of FIG. 1, illustrating the linkage mechanism in the fourth position.

With additional reference to FIGS. 9 and 10, once the prismatic joint 218 becomes engaged, the remaining travel of the handle 142 can bring the linkage 130 into a locked condition to exert pressure on the workpiece (not specifically shown) sandwiched between the upper platen 118 and the lower platen 122. In moving the handle 142 and linkage 130 to the position shown in FIGS. 9 and 10, corresponding to the locked condition, the upper structure 134 can resiliently bend or deform slightly relative to the lower structure 138. When moving the handle 142 and linkage 130 from the position shown in FIGS. 9 and 10 (i.e., locked condition) back to the position shown in FIGS. 7 and 8 (i.e., an unlocked condition), the upper structure 134 can resiliently return to its original position relative to the lower structure 138. The spring force of the upper structure resiliently bending can correspond to a predetermined clamp force.

Since the upper platen 118 is free to move vertically relative to the brake members 210 before the prismatic joint 218 engages, workpieces (not specifically shown) of different thicknesses can cause the upper platen 118 to move vertically relative to the brake members 210 before the prismatic joint 218 engages. Thus, the amount of vertical travel of the upper platen 118 after the upper platen 118 contacts the workpiece (not specifically shown) will be consistent and independent of the vertical position of the upper platen 118, since the prismatic joint 218 becomes locked at the same relative angle between the brake members 210 and the intermediate links 154 and handle 142. This allows for the same constant clamping force regardless of the thickness of the workpiece (not specifically shown), removing the need for conventional manual geometric adjustment. Furthermore, the resulting clamping force is also independent of the force applied by the operator, which can reduce the possibility of mechanism overload and variability between operators.

With reference to FIGS. 11-14 a heat press 1110 of a second construction is illustrated. The heat press 1110 can be similar to the heat press 110, except as otherwise shown or described herein. The heat press 1110 can include a base 1114, an upper platen, a lower platen, a heating element, and a clamping lever-crank mechanism or linkage 1118. The upper platen, lower platen, and heating element are not specifically shown in FIGS. 11-14 for simplicity, but can be similar to the upper platen 118, lower platen 122, and heating element 126 described above with reference to FIGS. 1-10.

Figure 11:
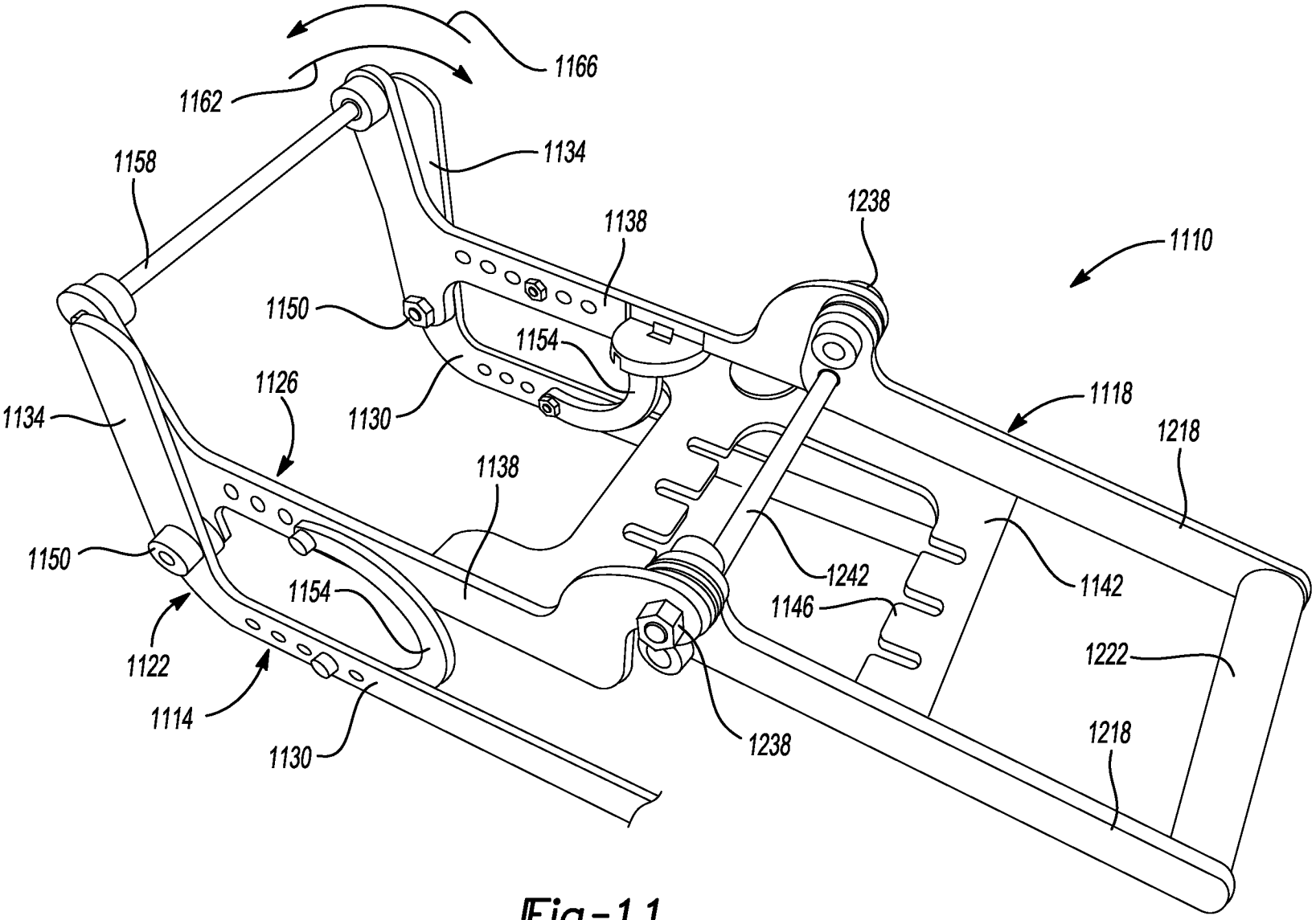
FIG. 11 is a perspective view of a base and a portion of a linkage mechanism of a heat press of a second construction in accordance with the present teachings.

With specific reference to FIG. 11, the base 1114 can include a lower structure 1122 and an upper structure 1126. The lower structure 1122 can have a pair of horizontal legs 1130 and a pair of back members 1134. The legs 1130 can be spaced apart and can stably support the heat press 1110 on a surface such as a table, for example. Each back member 1134 can be fixedly joined to and extend upward from a rear end of one of the legs 1130. The lower platen can be fixedly mounted to the lower structure 1122 above a forward end of the legs 1130.

The upper structure 1126 can include a pair of support members 1138 and a support plate 1142. The support members 1138 can be spaced apart and fixedly coupled together by the support plate 1142, which can extend between the support members 1138 proximate to a forward end of the support members 1138. The support plate 1142 can define an aperture 1146 that extends through a top and bottom surface of the support plate 1142 between the two support members 1138. A rear end of each support member 1138 can be pivotably coupled to a corresponding one of the back members 1134 by a pin 1150 (e.g., a bolt and nut). Each support member 1138 can be coupled to a corresponding one of the legs 1130 by a support link 1154. One end of the support link 1154 can be pivotably coupled to the support member 1138 at an intermediate area of the support member 1138 (e.g., an area between the rear end and the forward end). The opposite end of the support link 1154 can be pivotably coupled to a corresponding one of the legs 1130. In the example provided, the support link 1154 can have a "C" shape open toward the back members 1134, though other configurations can be used.

In the example provided a stop (e.g., stop bar 1158) can be coupled to the rear ends of the support members 1138 and can engage the lower structure 1122 (e.g., at the back members 1134) in a manner to prevent rotation of the upper structure 1126 in a first direction 1162 (e.g., clockwise as shown in FIG. 11) beyond the rotational position shown in FIG. 11, while not inhibiting rotation in a second direction 1166 (e.g., counter-clockwise as shown in FIG. 11) from the rotational position shown in FIG. 11. In an alternative configuration, the stop can be located on the lower structure 1122 (e.g., at the back members 1134) and configured to engage the support members 1138.

Figure 12:
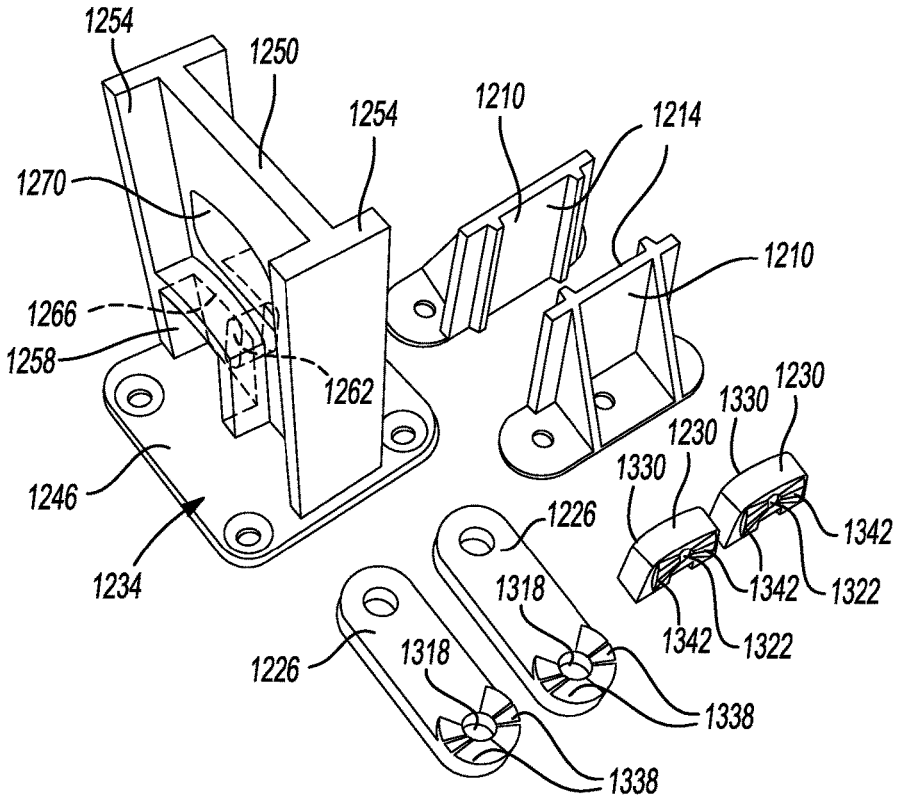
FIG. 12 is a perspective view of some components of the linkage mechanism of the heat press of FIG. 11.
Figure 13:
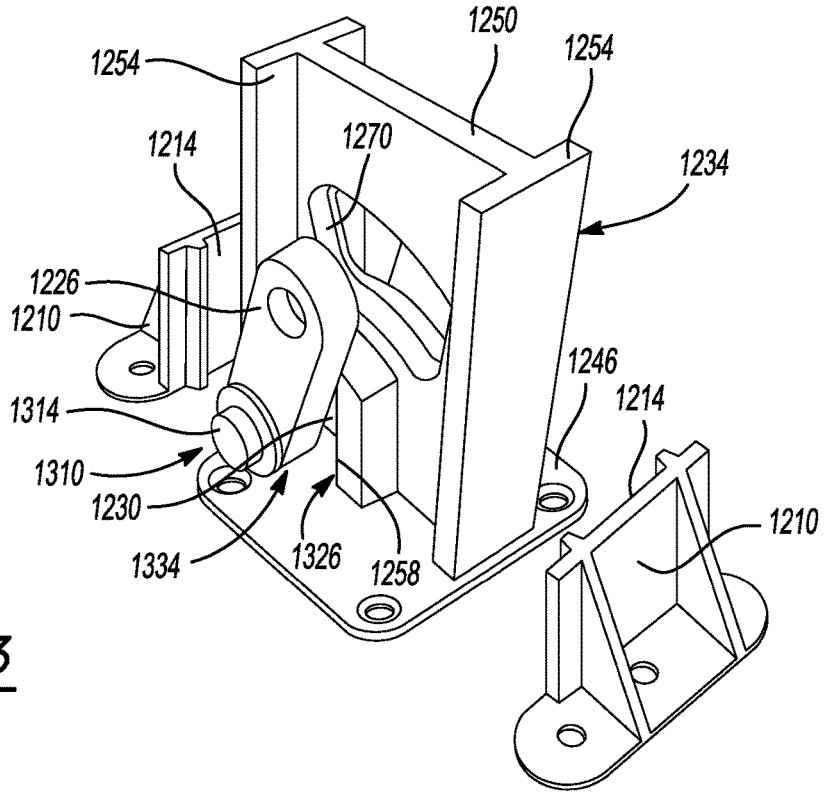
FIG. 13 is a perspective view of the components of FIG. 12, illustrating the components partially assembled.
Figure 14:
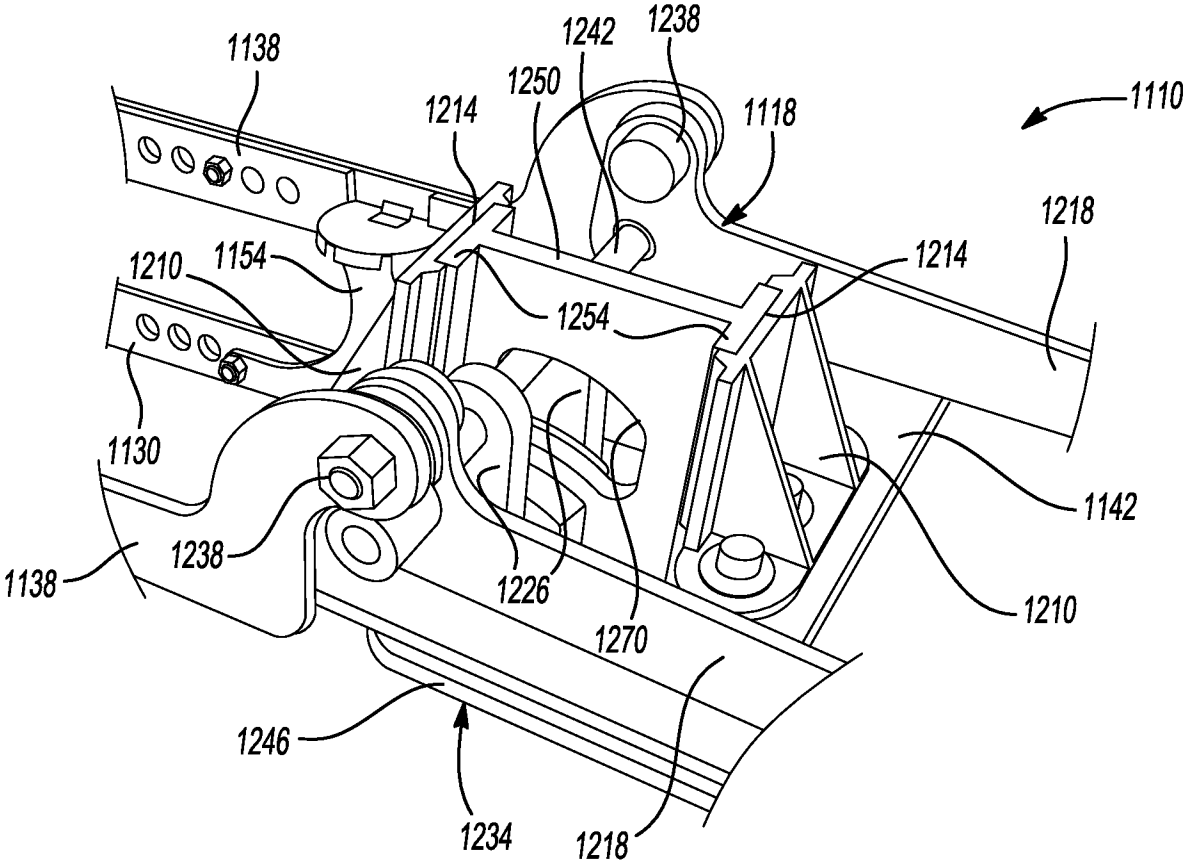
FIG. 14 is a perspective view of a portion of the heat press of FIG. 11, illustrating the components of FIG. 11 assembled on the base and linkage mechanism of FIG. 13.

With continued reference to FIG. 11 and further reference to FIGS. 12-14, the upper structure 1126 can further include a pair of guide blocks 1210. One of the guide blocks 1210 can be fixedly mounted to a forward side of the support plate 1142 (i.e., forward of the aperture 1146), while the other guide block 1210 can be fixedly mounted to a rear side of the support plate 1142 (i.e., rearward of the aperture 1146). Each guide block 1210 can have a channel 1214 open generally toward the aperture 1146, such that the channels 1214 oppose each other and extend longitudinally in the vertical direction (e.g., perpendicular to the upper surface of the support plate 1142.

The linkage 1118 can include a pair of arms 1218, a first link member (e.g., handle 1222), a pair of intermediate links 1226, a pair of first clutch members or brake members 1230, and a second clutch member or platen support body 1234. One end of each arm 1218 can be pivotably coupled to one of the support members 1138 proximate to the forward end of the support members 1138 and above the support plate 1142, such as by bolts or pins 1238. The opposite ends of the arms 1218 can be fixedly joined together by the handle 1222. In the example provided, a linkage rod 1242 extends between the ends of the arms 1218 that is opposite the handle 1222, such that the linkage rod 1242 is parallel to, but offset from the pins 1238. The intermediate links 1226, the brake members 1230, and the platen support body 1234 can be similar to the intermediate links 154, the brake members 210, and the platen support body 222 described above, except as otherwise shown or described herein.

In the example provided, the platen support body 1234 can include a platen flange 1246 that can be fixedly mounted to the upper platen, and a center wall 1250 that can be fixedly coupled to the platen flange 1246 and extend upward therefrom through the aperture 1146. The platen support body 1234 can be generally symmetric about the center wall 1250. The platen support body 1234 can include a pair of guide rails 1254 that extend upward along opposite ends of the center wall 1250, and a pair of guide grooves 1258 that extend laterally outward from opposite lateral sides of the center wall 1250. An elongated slot 1262, similar to slot 234 (FIGS. 1-10, described above) can extend through a portion of the opposite lateral sides of the center wall 1250 within the guide grooves 1258, which form parallel contact surfaces 1266, that can be similar to contact surfaces 226. The center wall 1250 can also define a window aperture 1270 above the guide grooves 1258 and above the slot 1262. The window aperture 1270 can extend through the center wall 1250. The guide rails 1254 can be slidably received in a corresponding one of the guide channels 1214 such that the platen support body 1234 is permitted to slide up and down relative to the upper structure 1126, while being inhibited from moving or rotating in other directions.

The intermediate links 1226 can have one end pivotably coupled to the arms 1218. In the example provided, the linkage rod 1242 extends through the one end of each intermediate link 1226 to pivotably support the intermediate links 1226 relative to the arms 1218. The linkage rod 1242 can extend freely through the window aperture 1270, such that the linkage rod 1242 does not interfere with the platen support body 1234. The opposite ends of each intermediate link 1226 can be pivotably connected to a corresponding one of the brake members 1230 via a rotating joint 1310 that can be similar to the rotating joint 214 (FIGS. 1-10, described above). In the example provided, the rotating joint 1310 includes a rod 1314 that extends through apertures 1318 in the intermediate links 1226, apertures 1322 in the brake members 1230, and the elongated slot 1262. In the example provided, the rod 1314 is a bolt and is secured in place by a nut. Washers and/or bearings (not specifically shown) may also be used to facilitate relative rotation between the rod 1314 and the intermediate links 1226 or brake members 1230.

The brake members 1230 can be similar to the brake members 210 (FIGS. 1-10, described above). The brake members 1230 can be connected by a prismatic joint 1326 parallel to the platen clamping direction and centrally located to the clamping force point of application (e.g., at the center wall which can be centered on the upper platen). The prismatic joint 1326 can include the platen support body 1234. The contact surfaces 1266 can each face one of the intermediate links 1226. Each brake member 1230 can have a mating contact surface 1330 that can be parallel to and oppose one of the contact surfaces 1266. In the example provided, each brake member 1230 can be slidably disposed within one of the guide grooves 1258.

The interface between the intermediate links 1226 and the brake members 1230 can be shaped to create a helical joint 1334 or screw pair connection. In the example provided, the helical joint 1334 includes a cam surface 1338 on each intermediate link 1226 and a follower surface 1342 on each brake member 1230, such that rotation of the intermediate links 1226 relative to the brake members 1230 can move the brakes laterally in the direction of their relative rotational axis. In other words, rotation of the intermediate links 1226 relative to the brake members 1230 can move the brake members 1230 toward or away from each other. This lateral movement of the brake members 1230 can cause interference in the prismatic joint 1326, engaging the brake members 1230 to the platen support body 1234 and locking the prismatic joint 1326 using frictional contact between the contact surfaces 1266 and the mating contact surfaces 1330. In an alternative construction, not specifically shown, the contact surfaces 1266 and mating contact surfaces 1330 can have interfering surface shapes such as interlocking teeth that can lock the prismatic joint 1326.

The heat press 1110 can be operated similar to the heat press 110, described above with reference to FIGS. 1-10, to allow for constant clamping force regardless of the thickness of the workpiece (not specifically shown). In the example provided, the shape, thickness, and material of the support link 1154 can correspond to the clamp force, such that the support link 1154 can resiliently bend in the second direction 1166 when the handle is moved to the fully clamped or locked position.

Figure 15:
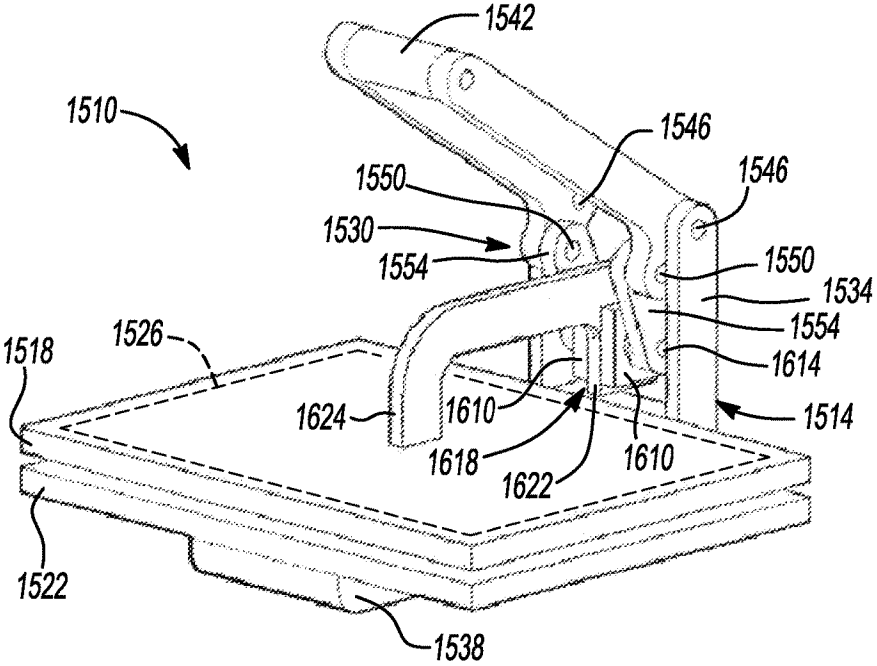
FIG. 15 is a perspective view of a heat press of a third construction in accordance with the present teachings.
Figure 16:
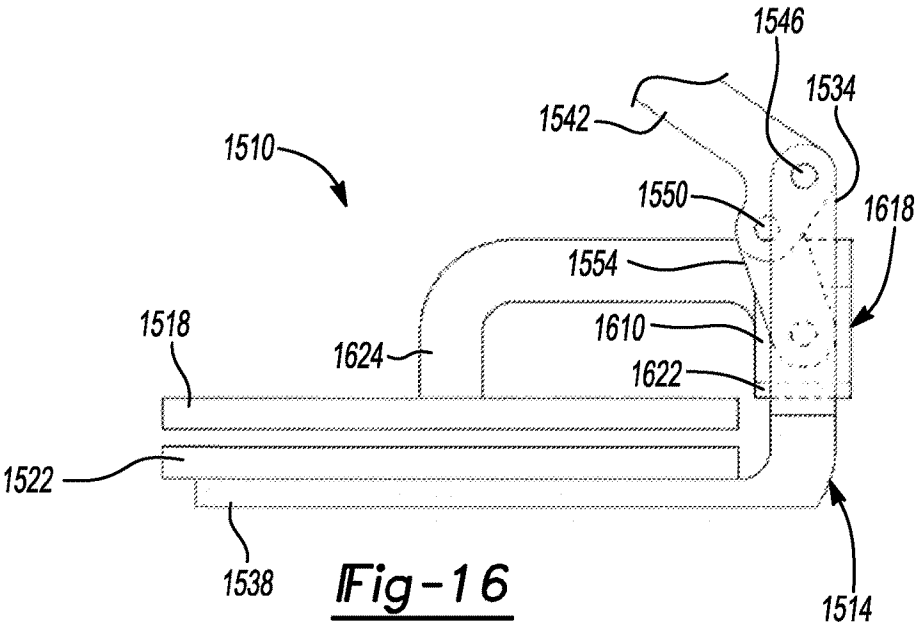
FIG. 16 is a side view of the heat press of FIG. 15.

With additional reference to FIGS. 15 and 16, a heat press 1510 of a third construction is illustrated. The heat press 1510 can be similar to the heat press 110, except as otherwise shown or described herein. The heat press 1510 can include a base 1514, an upper platen 1518, a lower platen 1522, a heating element 1526, and a clamping lever-crank mechanism or linkage 1530, that can be similar to the base 114, upper platen 118, lower platen 122, heating element 126, and linkage 130, except as otherwise shown or described herein.

The base 1514 can include an upper structure 1534 and a lower structure 1538 similar to the upper structure 134 and the lower structure 138, except as otherwise shown or described herein. In the example provided, the upper structure 1534 can extend upward from a rear of the lower structure 1538, but does not extend forward above the upper platen 1518. The linkage 1530 can include a first link member (e.g., handle 1542), which is movable by an operator and pivots about a joint 1546 on the upper structure 1534. The handle 1542 and joint 1546 can be similar to the handle 142 and joint 146, except that the joint 1546 can be located aligned with the upper structure 1534 (e.g., above the rear of the lower structure 1538 and not directly above the upper platen 1518). The handle 1542 can connect via rotating joints 1550 to a pair of intermediate links 1554, which can be referred to as "pressure links." The rotating joints 1550 can be similar to the rotating joints 150 and the intermediate links 1554 can be similar to the intermediate links 154.

With continued reference to FIG. 15 and additional reference to FIG. 16, each intermediate link 1554 can connect to a first clutch member or brake member 1610 via a rotating joint 1614. The brake members 1610 can be connected by a prismatic joint 1618 parallel to the platen clamping direction. The brake members 1610, rotating joint 1614, and the prismatic joint 1618 can be similar to the brake members 210, rotating joint 214, and prismatic joint 218, except as otherwise shown or described herein. In the example provided, the prismatic joint 1618 is located offset from the clamping force point of application (e.g., offset from the center on the upper platen 1518), and is located above the rear of the lower structure 1538 (e.g., generally aligned with the upper structure 1534). The prismatic joint 1618 can include a second clutch member or platen support body 1622 that can be similar to the platen support body 222, except that the platen support body 1622 is located above the rear of the lower structure 1538 (e.g., generally aligned with the upper structure 1534), and fixedly attached to the upper platen 1518 by a connecting arm 1624. The connecting arm 1624 can extend upward from a top surface of the upper platen 1518 and then extend rearward toward the upper structure 1534 to connect to the platen support body 1622.

Figure 17:
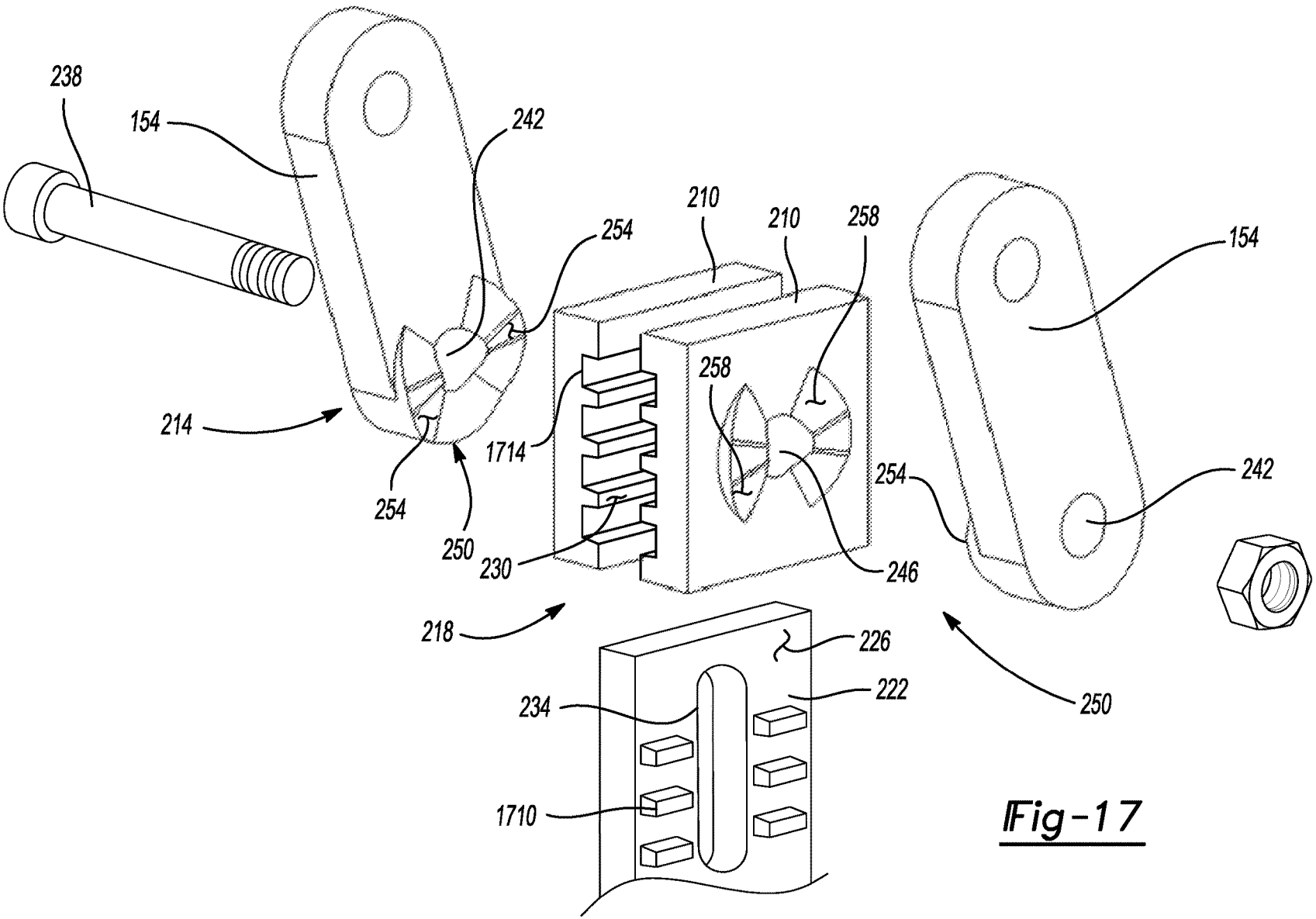
FIG. 17 is a perspective view similar to FIG. 2, illustrating a portion of a linkage mechanism for a heat press of a fourth construction.

With additional reference to FIG. 17, an alternative construction of the contact surfaces 226 and mating contact surfaces 230 are shown. The contact surfaces 226 and mating contact surfaces 230 can have interfering surface shapes such as interlocking teeth 1710, 1714 that can lock the prismatic joint 218. While the configuration illustrated in FIG. 17 is described with reference to the heat press of FIGS. 1-10, the configuration of FIG. 17 can be used on any of the constructions described herein, such as those of FIGS. 11-16, for example.

Figure 18:
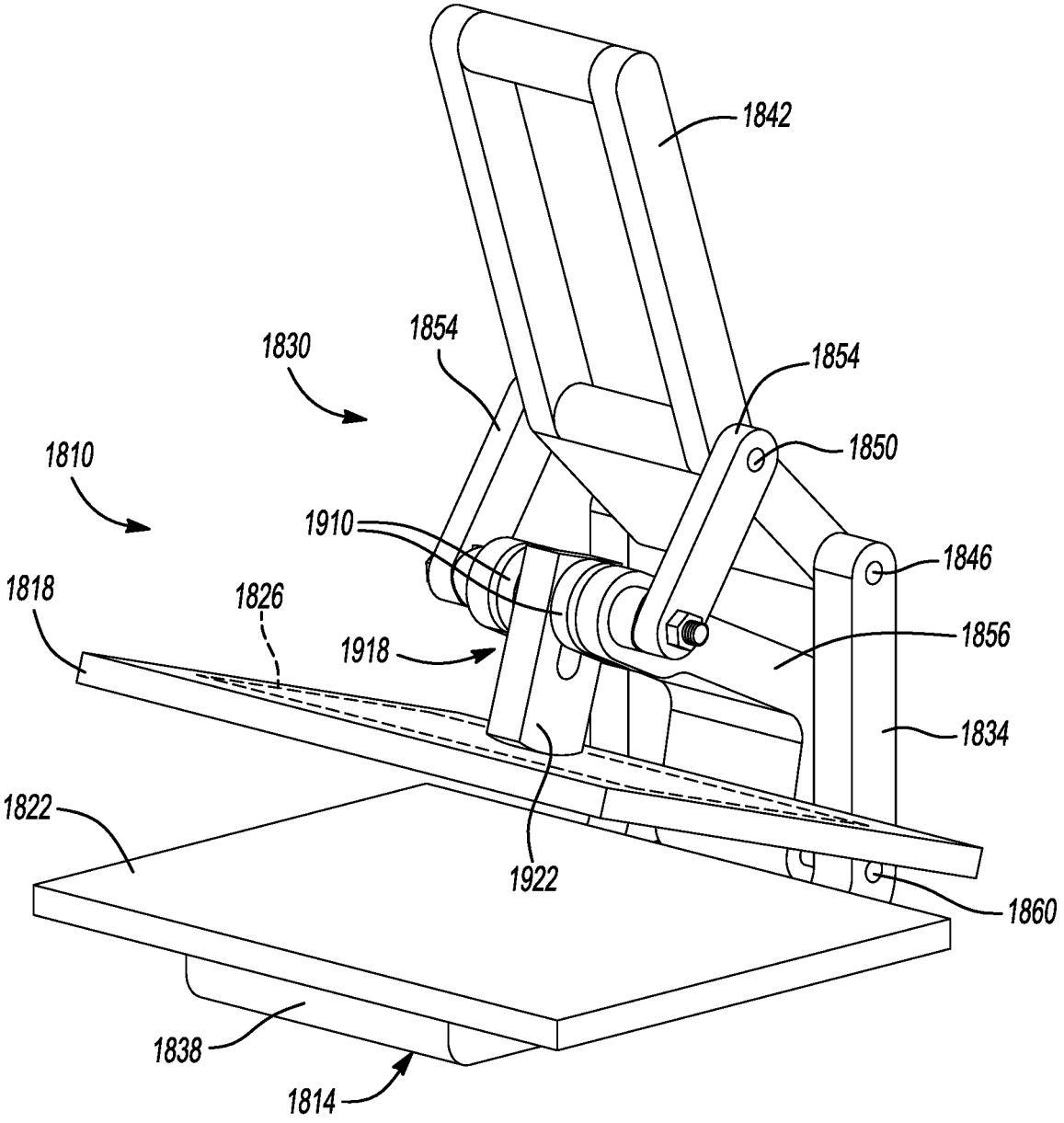
FIG. 18 is a perspective view of a heat press of a fifth construction.

With additional reference to FIG. 18, a heat press 1810 of another construction is illustrated. The heat press 1810 can be similar to the heat presses 110, 1510, except as otherwise shown or described herein. The heat press 1810 can include a base 1814, an upper platen 1818, a lower platen 1822, a heating element 1826, and a clamping lever-crank mechanism or linkage 1830, that can be similar to the base 114, 1514, upper platen 118, 1518, lower platen 122, 1522, heating element 126, 1526, and linkage 130, 1530, except as otherwise shown or described herein.

The base 1814 can include an upper structure 1834 and a lower structure 1838 similar to the upper structure 134, 1534, and the lower structure 138, 1538, except as otherwise shown or described herein. In the example provided, the upper structure 1834 can extend upward from a rear of the lower structure 1838, but does not extend forward above the upper platen 1818. The linkage 1830 can include a first link member (e.g., handle 1842), which is movable by an operator and pivots about a joint 1846 on the upper structure 1834. In the example provided, the handle 1842 and joint 1846 are similar to the handle 1542 and joint 1546. The handle 1842 can connect via rotating joints 1850 to a pair of intermediate links 1854, which can be referred to as "pressure links." The rotating joints 1850 can be similar to the rotating joints 150, 1550, and the intermediate links 1854 can be similar to the intermediate links 154, 1554.

Figure 19:
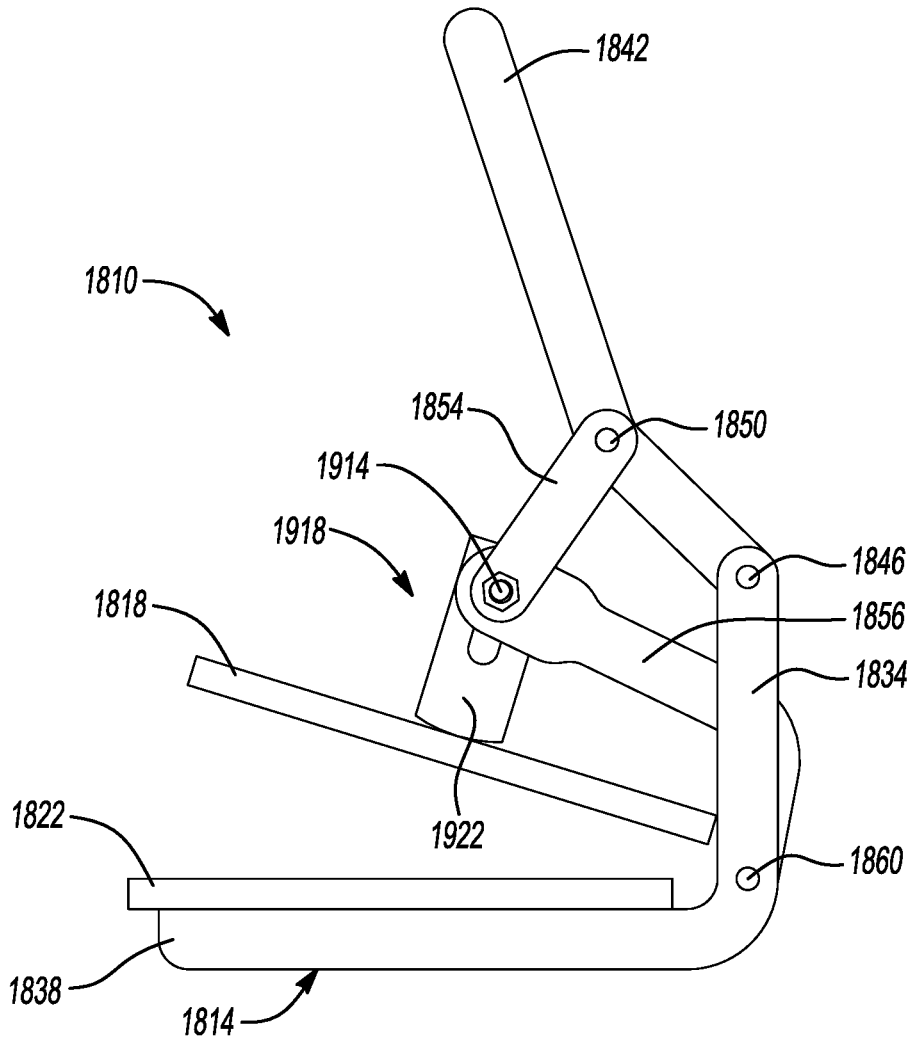
FIG. 19 is a side view of the heat press of FIG. 18, illustrating the heat press in an open position.
Figure 20:
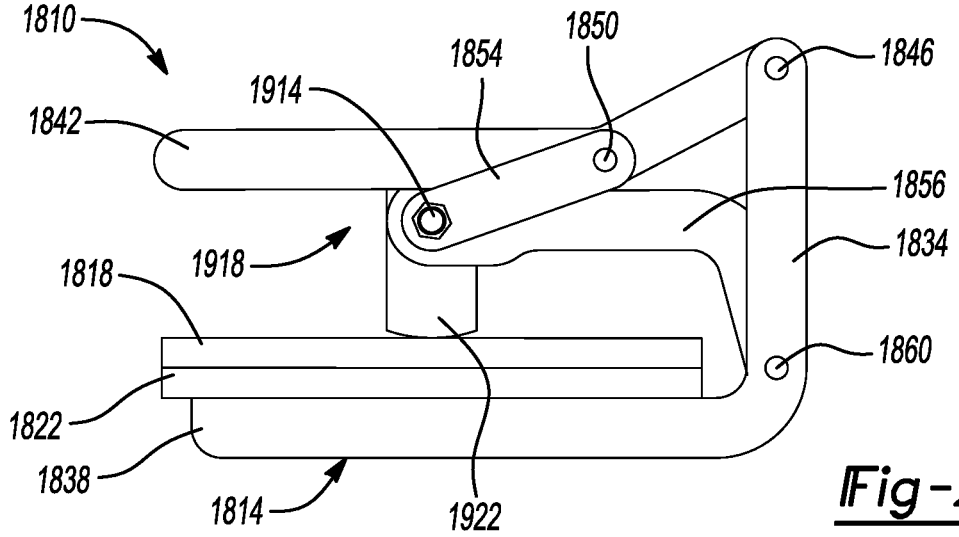
FIG. 20 is a side view of the heat press of FIG. 18, illustrating the heat press in a closed position.

With continued reference to FIG. 18 and additional reference to FIGS. 19 and 20, the linkage 1830 can also include a heater arm or (second link member 1856). The heat press 1810 is shown in an open position in FIG. 19 and in a closed position in FIG. 20. The second link member 1856 can have a first end that is pivotably coupled to the base 1814 at a joint 1860. The joint 1860 can be below the joint 1846, and in the example provided is at a lower portion of the upper structure 1834, i.e., proximal to the lower structure 1838. A second, opposite end of the second link member 1856 can be pivotably coupled to the intermediate links 1854 at a rotating joint 1914, at an end of the intermediate links 1854 that is opposite the joint 1850. In the example provided, the second link member 1856 can have a generally "L" shape, or dog-leg shape, such that when the heat press 1810 is in the closed position (e.g., FIG. 20) the second link member 1856 extends generally up and forward from the joint 1860 and then generally forward to the rotating joint 1914, though other configurations can be used.

Figure 21:
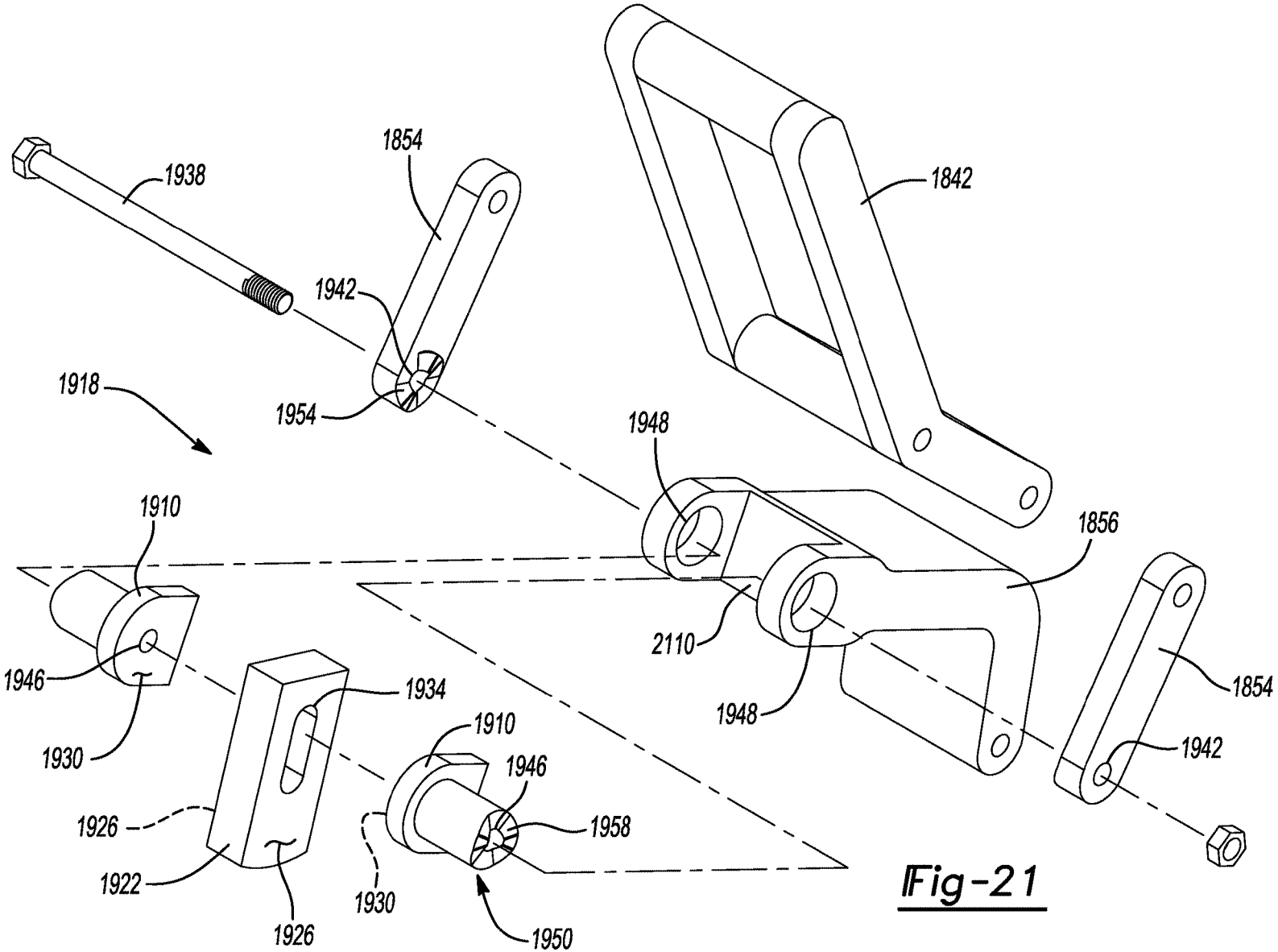
FIG. 21 is a perspective exploded view of a linkage mechanism of the heat press of FIG. 18.
Figure 22:
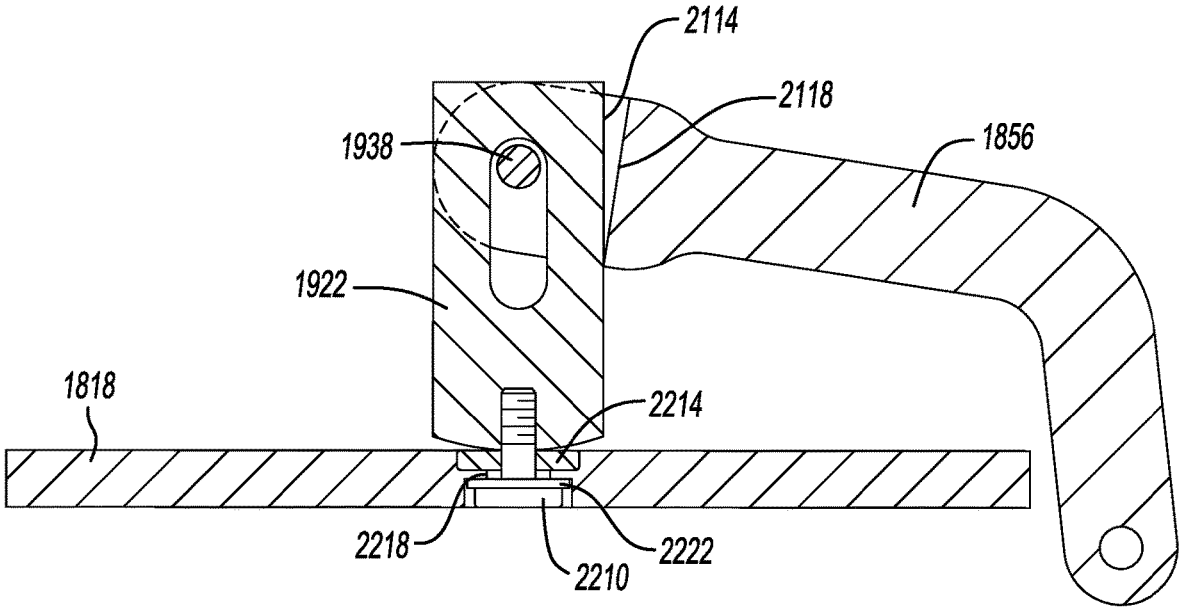
FIG. 22 is a sectional view of a portion of the linkage mechanism of FIG. 21.

With continued reference to FIGS. 18-20 and additional reference to FIGS. 21 and 22, each intermediate link 1854 can connect to a first clutch member brake member 1910 via the rotating joint 1914. The brake members 1910 can be similar to the brake members 210, 1610, except as otherwise shown or described herein. The brake members 1910 can be connected by a prismatic joint 1918 parallel to the platen clamping direction and centrally located to the clamping force point of application (e.g., centered on the upper platen 1818). The prismatic joint 1918 can include a second clutch member or platen support body 1922 that can be attached to the upper platen 1818, as described in greater detail below. The prismatic joint 1918 can be similar to the prismatic joint 218, 1618 and the rotating joint 1914 can be similar to the rotating joint 214, 1614, except as otherwise shown or described herein.

The platen support body 1922 can be similar to the platen support body 222, 1622. The platen support body 1922 can have a pair of opposite, parallel contact surfaces 1926 that each face one of the intermediate links 1854. In the example provided, each brake member 1910 can have a mating contact surface 1930 that can be parallel to and oppose one of the contact surfaces 1926. The contact surfaces 1926 and mating contact surfaces 1930 can be similar to the contact surfaces 226 and mating contact surfaces 230.

In the example provided, the platen support body 1922 includes an elongated slot 1934 that extends through the platen support body 1922 and through the contact surfaces 1926, similar to the elongated slot 234. The elongated slot 1934 can extend longitudinally in the clamping direction (e.g., up and down relative to the base 1814) and can be aligned with the rotating joint 1914. In the example provided, the rotating joint 1914 includes a rod 1938 that extends through apertures 1942 in the intermediate links 1854, apertures 1946 in the brake members 1910, apertures 1948 in the second end of the second link member 1856, and the elongated slot 1934. In the example provided, the rod 1938 is a bolt and is secured in place by a nut. Washers and/or bearings (not specifically shown) may also be used to facilitate relative rotation between the rod 1938 (e.g., bolt), and the intermediate links 1854, the brake members 1910, or the second link member 1856.

In the example provided, the second end of the second link member 1856 defines a channel 2110 that is open at the top and bottom of the second end of the second link member 1856. The apertures 1948 can be open to the channel 2110 such that the rod 1938 extends transversely through the channel 2110. The platen support body 1922 can extend through the channel 2110 and a rear face 2114 of the platen support body 1922 can oppose a forward face 2118 of the channel 2110. A portion of the brake members 1910 that includes the mating contact surfaces 1930 can be disposed within the channel 2110. In the example provided, a portion of each brake member 1910 that is opposite the respective mating contact surface 1930 can extend laterally outward through the apertures 1948 in the second link member 1856 to oppose a respective one of the intermediate links 1854. In the example provided, the apertures 1948 and the portion of each brake member 1910 that extends through the apertures 1948 are cylindrical in shape, though other configurations can be used.

The interface between the intermediate links 1854 and the brake members 1910 can be shaped to create a helical joint 1950 or screw pair connection, similar to the helical joint 250. In the example provided, the helical joint 1950 includes a cam surface 1954 on each intermediate links 1854 and a follower surface 1958 on each brake member 1910, such that rotation of the intermediate links 1854 relative to the brake members 1910 can move the brakes 1910 laterally in the direction of their relative rotational axis. In other words, rotation of the intermediate links 1854 relative to the brake members 1910 can move the brake members 1910 toward or away from each other. This lateral movement of the brake members 1910 can cause interference in the prismatic joint 1918, engaging the brake members 1910 to the platen support body 1922 and locking the prismatic joint 1918 using frictional contact between the contact surfaces 1926 and the mating contact surfaces 1930, or positive engagement similar to teeth 1710, 1714 (FIG. 17).

While not specifically shown, a spring can bias the brake members 1910 laterally outward such that the cam surfaces 1954 remain engaged with the follower surfaces 1958. Additionally, the clamping force can be adjusted by tightening or loosening the nut on the bolt of rod 1938, such that the cam and follower surfaces 1954, 1958 engage at different angular locations of the handle 1842 relative to the upper structure 1834.

In the example provided, the center of the elongated slot 1934 extends through the center of the apertures 1948 in the second link member 1856 and a perpendicular distance from the center of the elongated slot 1934 to the rear face 2114 is less than a perpendicular distance from the center of the apertures 1948 to the forward face 2118 of the channel 2110. Thus, the platen support body 1922 is permitted to rotate about the rod 1938 relative to the second link member 1856 across a small angle until the rear face 2114 contacts the top or bottom of the forward face 2118. Thus, gravity can tend to pull the upper platen 1818 to toward an orientation that is generally horizontal to the ground.

In the example provided, the platen support body 1922 is mounted to the upper platen 1818 in a manner that permits small relative motion or pivoting between the platen support body 1922 and the upper platen 1818, while biasing the upper platen 1818 toward a position where the upper platen 1818 is generally perpendicular to the platen support body 1922 (e.g., perpendicular to the elongated slot 1934). The platen support body 1922 can be mounted to the upper platen 1818 in any suitable self-righting or self-centering manner known in the art.

One, non-limiting example of a self-centering connection is illustrated in FIG. 22, and generally includes a bolt 2210 and a resilient (e.g., elastomeric) bushing 2214. The bolt 2210 can extends longitudinally along the same axis as the center of the elongated slot 1934. The shaft of the bolt 2210 can extend through an aperture 2218 in the center of the upper platen 1818, while the head of the bolt 2210 can be received in a counter-bore in the bottom of the upper platen 1818 to support the upper platen 1818. In the example provided, a washer 2222 is disposed between the head of the bolt 2210 and the upper platen 1818. The aperture 2218 can be wider than the shaft of the bolt 2210. The shaft of the bolt 2210 can be threaded into the bottom of the platen support body 1922 and the bushing 2214 can be disposed about the shaft of the bolt 2210 and between the upper platen 1818 and the platen support body 1922 to permit the upper platen 1818 to pivot slightly relative to the platen support body 1922, while biasing the upper platen 1818 to a centered position (e.g., perpendicular to the shaft of the bolt 2210. Alternatively or additionally, the washer 2222 can be a resilient bushing, and those of skill in the art will appreciate that other self-centering joints can be used other than the example provided.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein the first intermediate link member includes a first cam surface and the first clutch member includes a corresponding first follower surface configured to cooperate with the first cam surface to move the first clutch member toward the second clutch member when the first intermediate link member is rotated in the first rotational direction from the first rotational position to the second rotational position.

2. The heat press of claim 1, wherein the first intermediate link member and the first clutch member are pivotably coupled by a first pivot member and the first cam surface is disposed about the first pivot member.

3. The heat press of claim 1, wherein the linkage includes a second intermediate link member and the clutch includes a third clutch member, the second clutch member being disposed between the first and third clutch members, the second intermediate link member being pivotably coupled to the first link member, the third clutch member being pivotably coupled to the second intermediate link member, the second intermediate link member including a second cam surface and the third clutch member including a corresponding second follower surface configured to cooperate with the second cam surface to move the third clutch member toward the second clutch member when the first intermediate link member is moved from the first rotational position to the second rotational position;

wherein when the first intermediate link member is in the first rotational position, the second clutch member is permitted to move in the clamping direction relative to the third clutch member, and when the first intermediate link member is in the second rotational position, the third clutch member is engaged with the second clutch member to inhibit relative movement in the clamping direction between the second and third clutch members.

4. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein the second clutch member is disposed above the upper platen and a longitudinal axis of the second clutch member is aligned with a center of the upper platen, the longitudinal axis being parallel to the clamping direction.

5. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, a first intermediate link member pivotably coupled to the first link member, and a first brake member pivotably coupled to the first intermediate link member, the first intermediate link member including a first cam surface and the first brake member including a corresponding first follower surface; and a support body mounted to the upper platen for common movement with the upper platen, the support body and the first brake member being coupled together to form a prismatic joint, wherein the first cam surface and the first follower surface are configured to cooperate to move the first brake member relative to the support body between a disengaged position and an engaged position when the first intermediate link member rotates relative to the first brake member;

wherein when the first brake member is in the disengaged position, the support body is permitted to move relative to the first brake member along the clamping direction, wherein when the first brake member is in the engaged position, the first brake member engages the support body to inhibit movement of the support body in the clamping direction relative to the first brake member.

6. The heat press of claim 5, wherein the linkage includes a second intermediate link member and a second brake member, the second intermediate link member being pivotably coupled to the first link member, the second brake member being pivotably coupled to the second intermediate link member, the second intermediate link member including a second cam surface and the second brake member including a corresponding second follower surface;

wherein the support body is disposed between the first and second brake members, and wherein the second cam surface and the second follower surface are configured to cooperate to move the second brake member relative to the support body between a disengaged position and an engaged position when the second intermediate link member rotates relative to the second brake member;

wherein when the second brake member is in the disengaged position, the support body is permitted to move relative to the second brake member along the clamping direction, and wherein when the second brake member is in the engaged position, the second brake member engages the support body to inhibit movement of the support body in the clamping direction relative to the second brake member.

7. The heat press of claim 5, wherein the first brake member includes a first surface and the support body includes a second surface, wherein when the first brake member is in the engaged position, friction between the first and second surfaces inhibits movement of the support body in the clamping direction relative to the first brake member.

8. The heat press of claim 5, wherein the first link member includes a handle configured to be articulated by a user of the heat press.

9. The heat press of claim 5, wherein the support body is disposed above the upper platen and a longitudinal axis of the support body is aligned with a center of the upper platen, the longitudinal axis being parallel to the clamping direction.

10. The heat press of claim 5, wherein the first intermediate link member and the first brake member are pivotably coupled by a first pivot member and the first cam surface is disposed about the first pivot member.

11. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein the first clutch member is pivotally coupled to the first intermediate link member.

12. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein the first intermediate link member couples the first link member to the clutch.

13. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein engagement between the first clutch member and the second clutch member inhibits relative movement in the clamping direction between the first and second clutch members.

14. A heat press comprising:

a base;

a lower platen mounted to the base;

an upper platen;

a linkage configured to move the upper platen relative to the lower platen along a clamping direction between a first platen position and a second platen position wherein the upper platen is spaced apart from the lower platen a lesser distance than when in the first platen position, the linkage including a first link member pivotably coupled to the base, and a first intermediate link member pivotably coupled to the first link member and configured to rotate in a first rotational direction from a first rotational position to a second rotational position; and a clutch including a first clutch member and a second clutch member, the first clutch member being pivotably coupled to the first intermediate link member, the second clutch member being mounted to the upper platen for movement in the clamping direction with the upper platen;

wherein when the first intermediate link member is in the first rotational position, the clutch is disengaged to permit relative movement in the clamping direction between the first and second clutch members, and when the first intermediate link member is in the second rotational position, the clutch is engaged to inhibit relative movement in the clamping direction between the first and second clutch members;

wherein the first intermediate link member is configured to rotate from the first rotational position to the second rotational position in response to movement of the first link member.

* * * * *